United States Patent [19]

Stringer

[11] 4,095,799

[45] Jun. 20, 1978

[54] CORPORATE LADDER GAME

[76] Inventor: Claude A. Stringer, 7317 S. Winchester, Chicago, Ill. 60636

[21] Appl. No.: 781,706

[22] Filed: Mar. 28, 1977

[51] Int. Cl.[2] ..... A63F 3/00

[52] U.S. Cl. ..... 273/241; 273/236

[58] Field of Search ..... 273/130 R, 130 AC, 135 R, 273/136 H, 135 C

[56] References Cited

U.S. PATENT DOCUMENTS

| | | | |
|---|---|---|---|
| 1,013,161 | 1/1912 | Hewitt, Jr. | 273/135 C |
| 1,365,561 | 1/1921 | Sterling | 273/130 R |
| 2,230,699 | 2/1941 | Schulze | 273/148 R |

FOREIGN PATENT DOCUMENTS

| | | | |
|---|---|---|---|
| 2,281,142 | 3/1976 | France | 273/135 AA |

*Primary Examiner*—Anton O. Oechsle

[57] ABSTRACT

Game apparatus including a game board having slots simulating the rungs on a ladder. Each rung has indicia associated therewith corresponding to a corporate job category. Chips are selected from a container which bear indicia corresponding to one of the job categories. A sheet provided with the apparatus assigns a monetary value to the chip selected by a player, who notes this amount and places the chip in the corresponding rung of the gameboard. The player who accumulates the highest monetary total at the end of the game is declared the winner. The chips contain indicia determining the number of turns a player may take in selecting chips. By viewing the number of chips previously selected in each category and being advised of the total number of chips available in each category by checking the chip sheet, a player can determine his chance of success in selecting a high value chip. If this chance is poor, the player may opt to choose a chip from a second container provided with monetary indicia which may be added or substituted from his accumulated monetary total.

5 Claims, 4 Drawing Figures

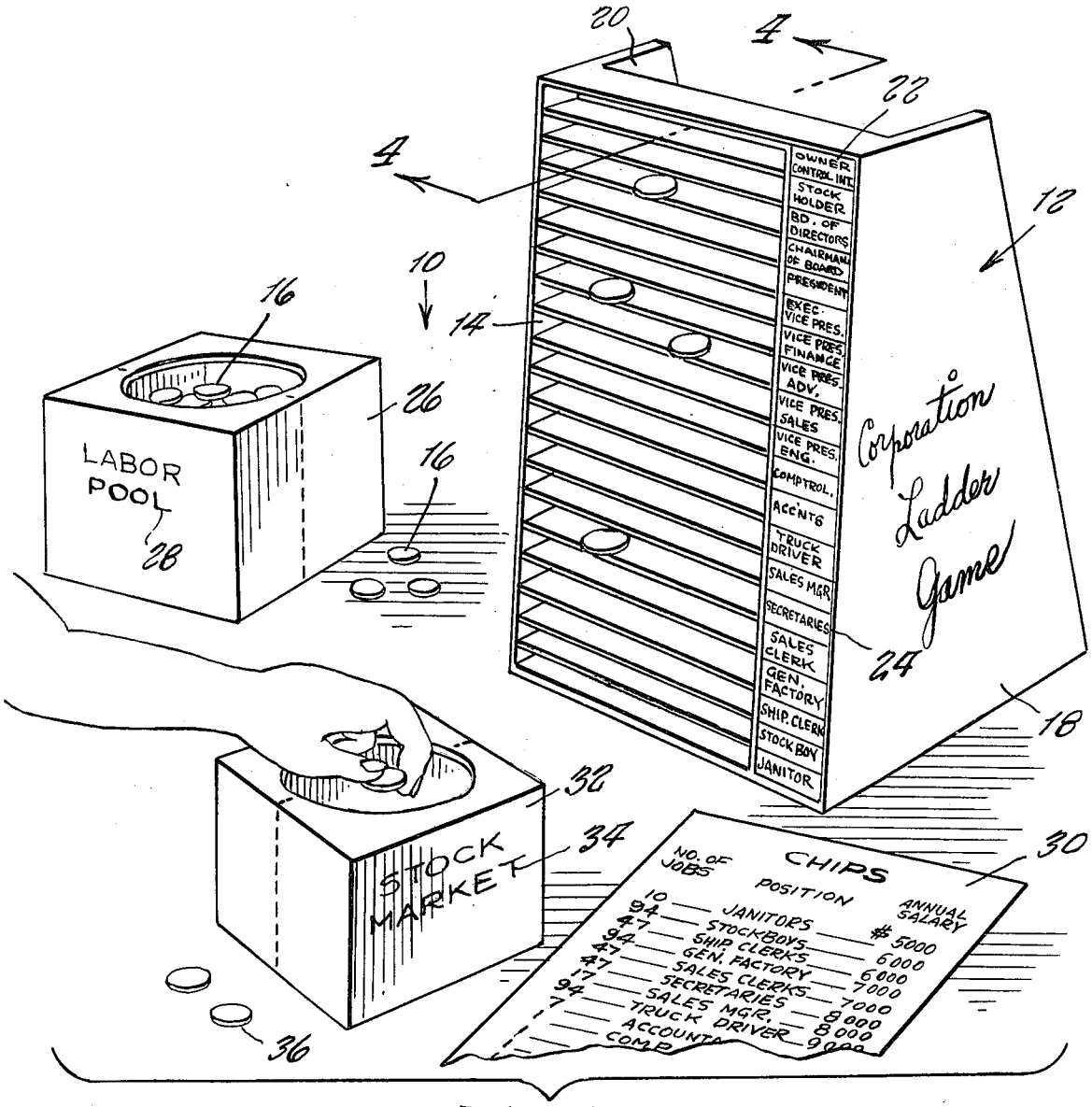
Fig. 1
Fig. 2
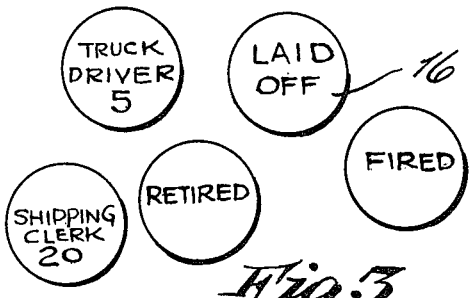
Fig. 3
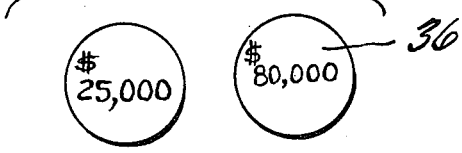
Fig. 4
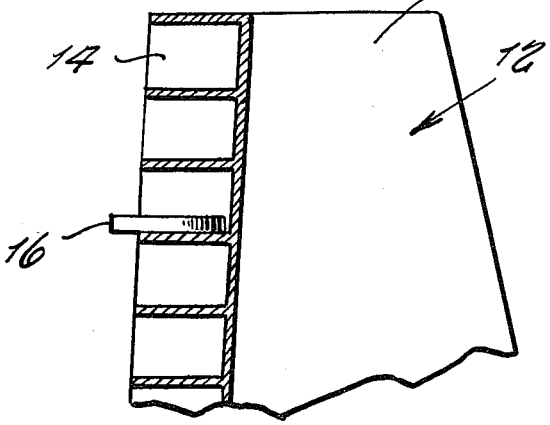

CORPORATE LADDER GAME

BACKGROUND OF THE INVENTION

This invention relates to game apparatus including a game board and a plurality of playing pieces for use in playing a game simulating the advancement of employees in a corporation.

Numerous types of game apparatus are known in the prior art utilizing game boards and game pieces but none are known to have the applicant's use of the type of game board, game pieces, and instruction sheets.

SUMMARY OF THE INVENTION

In accordance with the invention, a game board simulating rungs on a ladder is provided, each rung representing a different level of corporate accomplishment. The object of the game is to become the owner of a controlling interest of the corporation. This is accomplished by having each game participant draw a chip from a container marked "LABOR POOL" which assigns a job position to the participant for a number of years, who places his chip in the corresponding rung on the corporate ladder game board. Each job pays a particular salary specified on a chip sheet. The number of years in a particular position is multiplied by the specified salary and noted on a scratch pad. Each participant starts out at age 18 and has 47 years to make as much money as he can before he retires. Play progresses and in his turn a player can increase his earnings, while decreasing his years to retirement. Any player with the most money accumulated at the end of the game is declared the owner.

The chip sheet provided shows the total number of chips in each category, so a player by inspecting the chips accumulated in each rung of the game board, can gauge the success of picking out a chip of high monetary value on his next turn. If he feels that his change of imminent success is poor, he can opt to select a chip from a second container labeled "STOCK MARKET." The chips in this container are marked with dollar amounts of higher or lower value than a player has selected to invest of his accumulated earnings. If the player pulls a lower value chip he adds that value to his accumulated earnings score, otherwise, if a higher chip is selected, he subtracts the amount invested.

Certain chips in the "LABOR POOL" container may call for the employee to be fired, laid off or retired. If a player selects such a chip, he is immediately eliminated from the game.

BRIEF DESCRIPTION OF THE DRAWING

Further objects and advantages of the invention will become apparent from the following description and claims, and from the accompanying drawing, wherein:

FIG. 1 is a perspective view of the game apparatus of the present invention;

FIG. 2 is a front view in elevation of some of the different job chips of the apparatus of FIG. 1;

FIG. 3 is a front view in elevation of some of the different stock market chips of the apparatus of FIG. 1; and FIG. 4 is a cross-sectional view taken substantially along the plane indicated by line 4—4 of FIG. 1.

DETAILED DESCRIPTION OF THE PREFERRED EMBODIMENT

Referring now to the drawing in detail, wherein like numerals indicate like elements throughout the several views, the game apparatus 10 of the present invention includes a gameboard 12 formed from cardboard or plastic which simulates a ladder with slots or rungs 14 for receiving plastic chips 16. Gameboard 12 includes support wings 18 and 20 connected to an upright face 22 in which rungs 14 are formed. Adjacent each rung 14 on face 22 of gameboard 12 are a plurality of indicia 24 representing a different level of corporate accomplishment ranging from "JANITOR" to "OWNER CONTROLLING INTEREST."

The object of the game is to become the owner of the controlling interest of the corporation by accumulating the most amount of money at the end of the game. This is accomplished by having each game participant draw a chip 16 from a container 26 marked with indicia 28 forming the words "LABOR POOL" which assigns one of the job categories 24 to the participant for a number of years, as for example, the chip 16 in FIG. 2 bearing the indicia "SHIPPING CLERK, 20". This chip 16 is placed in the corresponding rung 14 on the corporate ladder gameboard 12. Each job pays a particular salary specified on a chip sheet 30, provided as a portion of the game apparatus 10. The number of years on chip 16 is multiplied by the specified salary on sheet 30 and noted on a scratch pad. Each participant starts out at age 18 and has 47 years to make as much money as he can before he retires at age 65. Play progresses and in his turn a player can increase his earnings, while decreasing his years to retirement. Any player with the most money accumulated at the end of the game, i.e., when each player reaches 65 or is otherwise eliminated is declared the owner.

Certain chips 16 in the "LABOR POOL" container 26 may call for the employee to be fired, laid-off or retired. If a player selects such a chip 16, he is immediately eliminated from the game.

The chip sheet 30 shows the total number of chips in each category 24, so a player by inspecting the chips 16 accumulated in each rung 14 of gameboard 12, can gauge the success of picking out a chip 16 of high monetary value on his next turn. A typical chip sheet 30 is reproduced below:

CHIPS

| Number of Jobs: | Position | Annual Salary |
|---|---|---|
| 10 | Janitors | $ 5,000.00 |
| 94 | Stockboy | 6,000.00 |
| 47 | Shipping Clerks | 6,000.00 |
| 94 | General Factory | 7,000.00 |
| 47 | Sales Clerks | 7,000.00 |
| 47 | Secretaries | 8,000.00 |
| 17 | Sales Manager | 8,000.00 |
| 94 | Truck driver | 9,000.00 |
| 7 | Accountants | 10,000.00 |
| 1 | Comptroller | 15,000.00 |
| 1 | Vice-President Engineering | 25,000.00 |
| 1 | Vice-President Sales/ Marketing | 30,000.00 |
| 1 | Vice-President Advertising | 35,000.00 |
| 1 | Vice-President Finance | 40,000.00 |
| 1 | Executive Vice President | 50,000.00 |
| 1 | President | 75,000.00 |
| 1 | Chairman of the Board | 100,000.00 |
| 17 | Board of Directors | 65,000.00 |
| 47 | Stock holders | 1,000.00 to 46,000.00 |
| 1 | Owner controling interest | 51% or 6,000,000.00 |

If a player feels that his chance of imminent success in picking a high value chip 16 is poor, he can opt to select a chip 36 from a second container 32 bearing indicia 34 forming the words "STOCK MARKET." The chips 36 are marked with dollar amounts of higher or lower value than a player has selected to invest of his accumulated earnings. If the player selects a lower value chip 36 he adds that value to his accumulated earnings score, otherwise, if a higher chip is selected, he subtracts the amount invested. The chips 36 are broken down as follows:

The Stock Market

| Number of Chips | Net Worth |
|---|---|
| 10 | $ 0 |
| 20 | 100.00 |
| 20 | 500.00 |
| 20 | 1,000.00 |
| 20 | 2,000.00 |
| 20 | 3,000.00 |
| 20 | 4,000.00 |
| 10 | 5,000.00 |
| 10 | 10,000.00 |
| 9 | 15,000.00 |
| 8 | 20,000.00 |
| 7 | 25,000.00 |
| 6 | 30,000.00 |
| 5 | 35,000.00 |
| 4 | 40,000.00 |
| 4 | 50,000.00 |
| 4 | 100,000.00 |
| 4 | 500,000.00 |
| 4 | 1,000,000.00 |

The chips 36 may also be marked with years that must be deducted from the 47 years available for corporate earning power.

I claim:

1. Game apparatus comprising:

an upright gameboard having a plurality of slots in a front face thereof simulating rungs on a ladder, a plurality of indicia on the front face of said gameboard associated with each slot therein designating a job category in a corporation, a container, a plurality of chips in said container, preselected ones of said chips corresponding to one of the job categories on said gameboard and containing a number indicum, and a chip sheet containing indicia associated with the monetary value of the job represented by each of said chips, whereby a player can select one of said chips and multiply the monetary value of the chip indicated on the chip sheet by the number indicum on said chip to obtain a point value, the number indicum on said chip also being used to establish the number of turns remaining for the player selecting said chips, and the selected chip being disposed in the corresponding job category slot in the front face of said gameboard.

2. Game apparatus in accordance with claim 1 wherein said chip sheet contains indicia indicating the number of chips in each job category so a player can gauge his chance of success of selecting a high value chip by viewing the number of chips corresponding to a particular job category accumulated in the corresponding slot on said gameboard.

3. Game apparatus in accordance with claim 1 wherein preselected ones of said chips include indicum for eliminating a player from continuing to play said game.

4. Game apparatus in accordance with claim 1, including a second container, a plurality of chips in said second container, each of said chips including an indicum corresponding to a monetary amount which can be added or subtracted from the accumulated point value of the player.

5. Game apparatus in accordance with claim 1 wherein said gameboard includes upright supports extending rearwardly from the opposite lateral edges of the front face thereof.

* * * * *